US007584932B2

(12) United States Patent
Shih

(10) Patent No.: US 7,584,932 B2
(45) Date of Patent: Sep. 8, 2009

(54) CONSTRUCTION PROP

(76) Inventor: Lung Ching Shih, No. 238, Sec. 3, Chung-Kang Rd., Taichung (TW)

( * ) Notice: Subject to any disclaimer, the term of this patent is extended or adjusted under 35 U.S.C. 154(b) by 0 days.

(21) Appl. No.: 11/877,368

(22) Filed: Oct. 23, 2007

(65) Prior Publication Data

US 2009/0101774 A1 Apr. 23, 2009

(51) Int. Cl.
*A47F 5/00* (2006.01)
*E04G 25/00* (2006.01)
*F16M 13/00* (2006.01)

(52) U.S. Cl. ..... 248/354.3; 248/354.4; 248/200.1; 248/688; 248/644; 248/125.2; 248/125.8; 248/354.1; 411/265; 411/433; 411/436; 411/246

(58) Field of Classification Search ..... 248/200.1, 248/688, 644, 125.2, 125.8, 354.1, 354.3, 248/354.4; 411/265, 433, 436, 246
See application file for complete search history.

(56) References Cited

U.S. PATENT DOCUMENTS 2,261,061 A * 10/1941 Horton ..... 248/200.1
2,988,318 A * 6/1961 Ferguson et al. ..... 248/354.1
3,822,850 A * 7/1974 Elias ..... 248/551
3,851,856 A * 12/1974 Berg ..... 254/93 R
3,870,268 A * 3/1975 Larkin ..... 248/354.1
3,920,220 A * 11/1975 Elias ..... 254/98
3,991,964 A * 11/1976 Christopher ..... 248/354.1
4,527,363 A * 7/1985 Saether ..... 52/122.1
5,060,903 A * 10/1991 Schworer ..... 248/354.3
5,590,863 A * 1/1997 Sasaki ..... 248/354.3
5,758,854 A * 6/1998 Shih ..... 248/354.3
5,826,847 A * 10/1998 Warner et al. ..... 248/354.1
6,050,764 A * 4/2000 Oberle et al. ..... 411/354
6,247,882 B1 * 6/2001 Huang ..... 410/151
6,394,405 B1 * 5/2002 Roxton et al. ..... 248/354.1
6,467,741 B1 * 10/2002 Shih ..... 248/200.1
6,481,912 B2 * 11/2002 Shih ..... 403/49
6,508,448 B1 * 1/2003 Stewart ..... 248/354.1
6,746,183 B1 * 6/2004 Sullivan ..... 405/272
7,240,885 B1 * 7/2007 Sullivan ..... 248/354.1
7,273,200 B2 * 9/2007 Funes Gavilan ..... 248/354.1
7,290,742 B2 * 11/2007 Wang ..... 248/200.1
7,309,190 B1 * 12/2007 Sullivan ..... 405/278
2005/0161571 A1 * 7/2005 Wood ..... 248/354.3

* cited by examiner

*Primary Examiner*—J. Allen Shriver, II
*Assistant Examiner*—Nkeisha J Smith
(74) *Attorney, Agent, or Firm*—Ming Chow; Sinorica, LLC

(57) ABSTRACT

A construction prop includes an outer tube and an inner tube wherein the inner tube telescopically fitted in the outer tube. The top end of the outer tube has a threaded section axially formed with a pair of slots. The inner tube is axially formed with several pairs of pinholes. A locating nut is screwed on the threaded section of the outer tube. A controlling member formed with a pair of through holes is fitted on the outer tube. A bottom end of the controlling member is rotatably connected with the locating nut. A top face of the controlling member is formed with recessed/projecting structures. An insertion pin is fitted through the slots of the outer tube and inserted in one pair of pinholes of the inner tube, and is rested on the top face of the controlling member, whereby the prop can support a horizontal moldboard.

14 Claims, 7 Drawing Sheets

CONSTRUCTION PROP

FIELD OF THE INVENTION

The present invention is related to a construction equipment, and more particularly to a prop.

BACKGROUND OF THE INVENTION

FIGS. 1 and 2 show a conventional prop 10 for supporting moldboards. The prop 10 includes an outer tube 12, a threaded tube 13 fixed at a top end of the outer tube 12 and an inner tube 15 telescopically fitted in the threaded tube 13 and the outer tube 12. The threaded tube 13 is formed with a pair of axial slots 14. The inner tube 15 is formed with several pairs of pinholes 16 arranged at equal intervals. A locating nut 17 is adjustably screwed on the threaded tube 13. An insertion pin 18 is passed through the slots 14 of the threaded tube 13 and inserted into one pair of pinholes of the inner tube 15. In use, the inner and outer tubes 15, 12 are adjusted to a necessary length and then the insertion pin 18 is inserted through the slots 14 of the threaded tube 13 into one pair pinholes 16 of the inner tube 15. The insertion pin 18 is supported by the locating nut 17. By means of turning the nut 17, the length of the inner tube 15 extending out of the outer tube 12 can be adjusted, whereby the prop serves to support a moldboard.

The conventional prop 10 has some shortcomings as follows:

First, the length of the prop is adjusted by means of turning the locating nut 17. It takes much time to complete such procedure. Therefore, a user can hardly quickly conveniently adjust the length of the prop to a necessary length.

Second, such prop 10 is designed for bearing pressure only. Therefore, the prop 10 cannot bear pulling force. In the case that an axial pressure is applied to the prop 10, the inner tube 15 is supported by the nut 17 without being retracted into the outer tube 12. However, in the case that an axial pulling force is applied to the prop, the inner tube will slide and displace. Accordingly, the prop can only bear one-way action force, that is, the axial pressure. Therefore, such prop is inapplicable to the situation of bidirectional action force so that the application range of such prop is narrowed.

U.S. Pat. No. 6,467,741 entitled "steel prop capable of bearing bidirectional applied force" of this applicant discloses a prop capable of bearing bidirectional action force. However, it is relatively inconvenient to operate such prop. In addition, the prop has a relatively complicated structure.

SUMMARY OF THE INVENTION

It is therefore a primary object of the present invention to provide a prop which can be quickly adjusted in length.

It is a further object of the present invention to provide the above prop which is able to bear both axial pressure and tension. Therefore, the application range of the prop is widened.

The present invention can be best understood through the following description and accompanying drawings wherein:

DETAILED DESCRIPTION OF THE PREFERRED EMBODIMENTS

Figure 1:
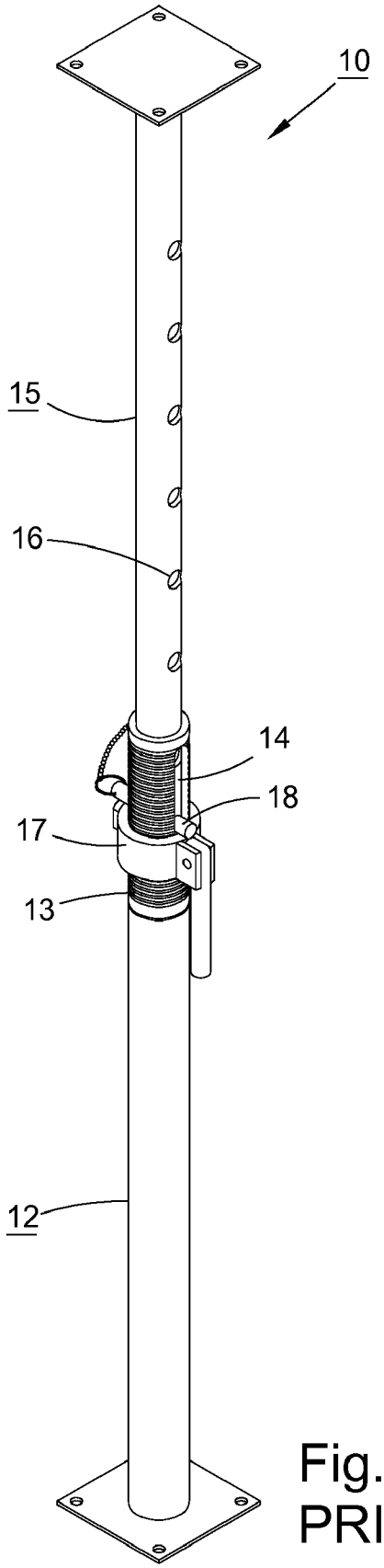
Fig. 1 PRIOR ART
FIG. 1 is a perspective view of a conventional prop.
Figure 2:
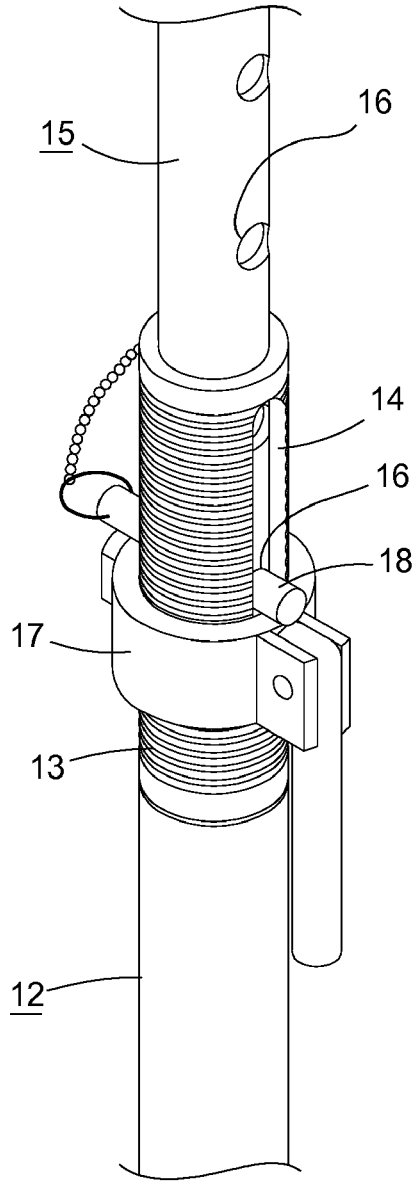
Fig. 2 PRIOR ART
FIG. 2 is an enlarged view of a part of the prop of FIG. 1.
Figure 3:
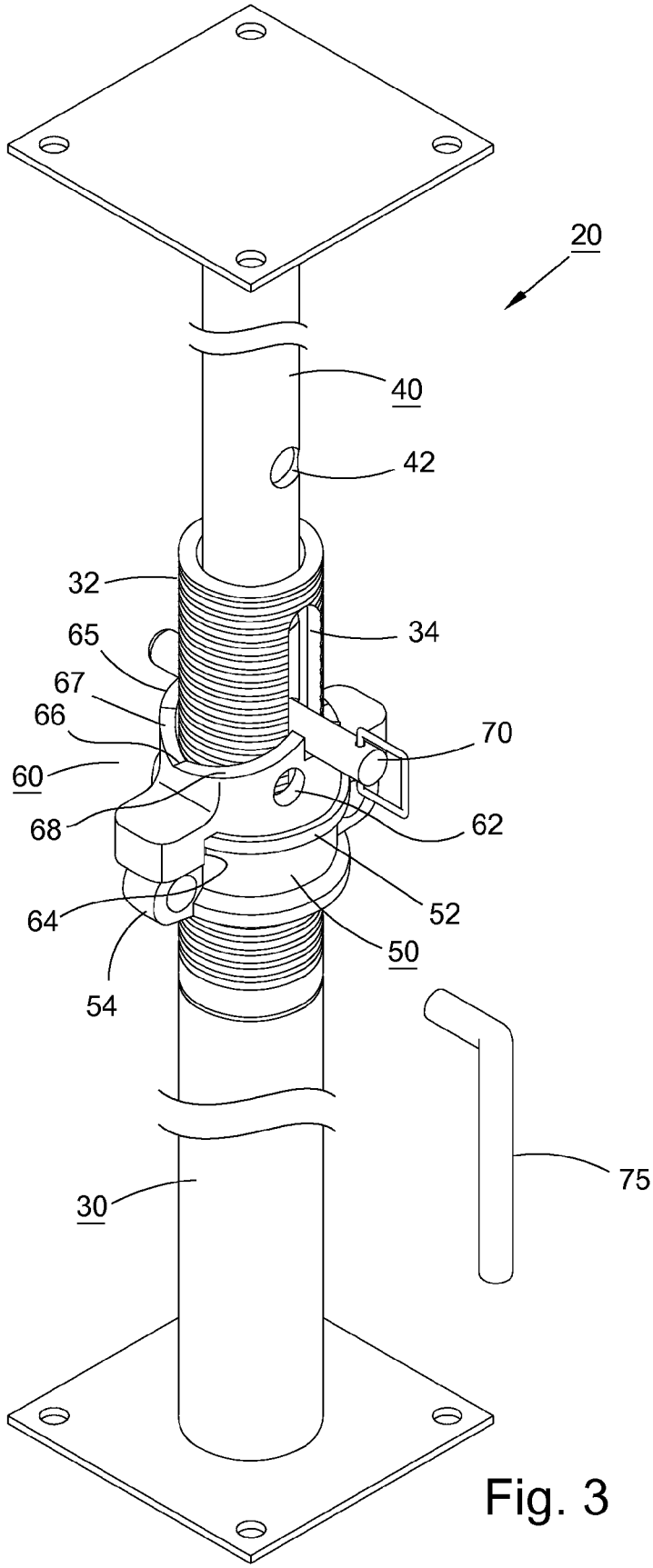
FIG. 3 is a perspective view of a first embodiment of the prop of the present invention.
Figure 4:
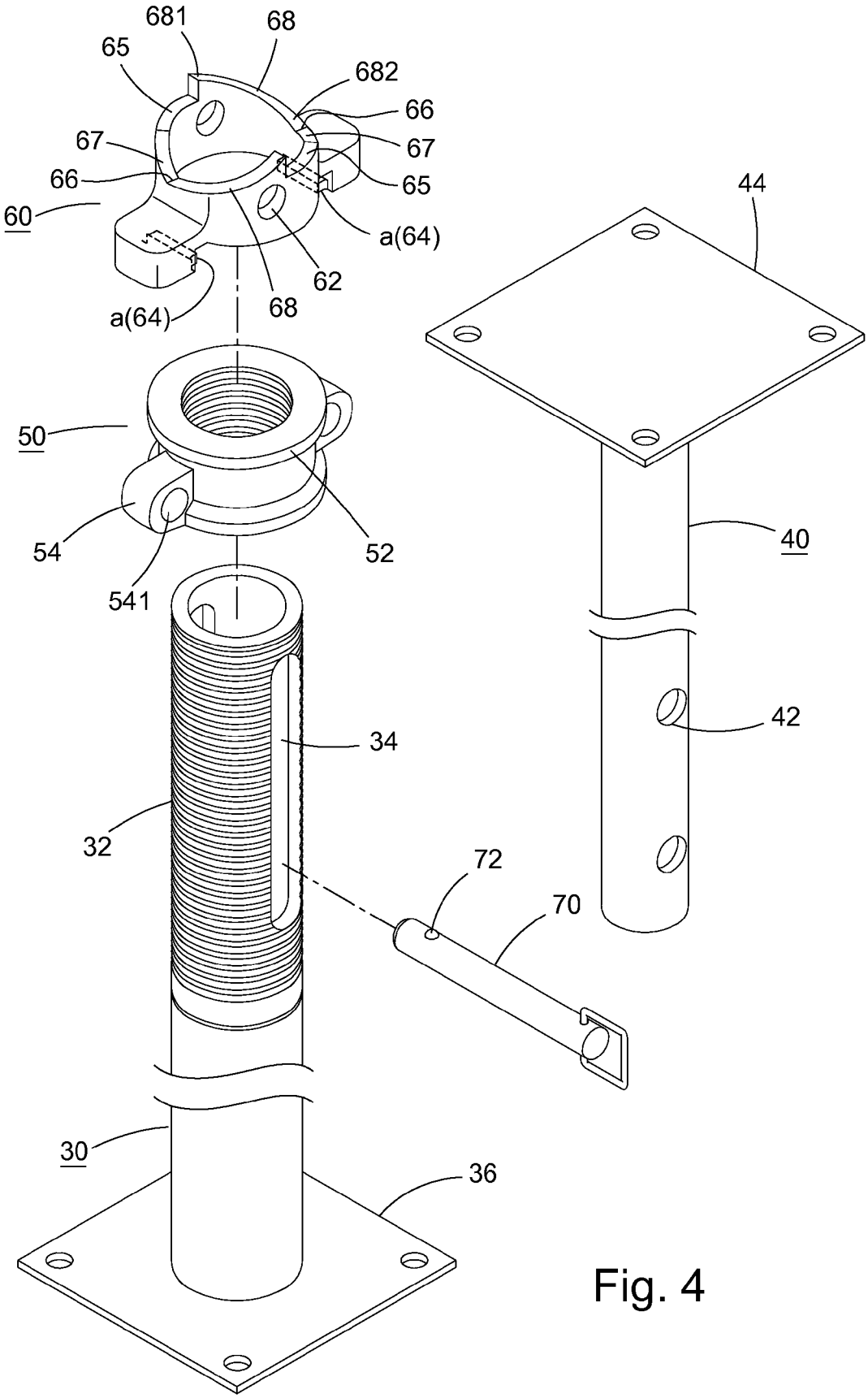
FIG. 4 is a perspective exploded view of the first embodiment of the prop of the present invention according to FIG. 3.
Figure 5:
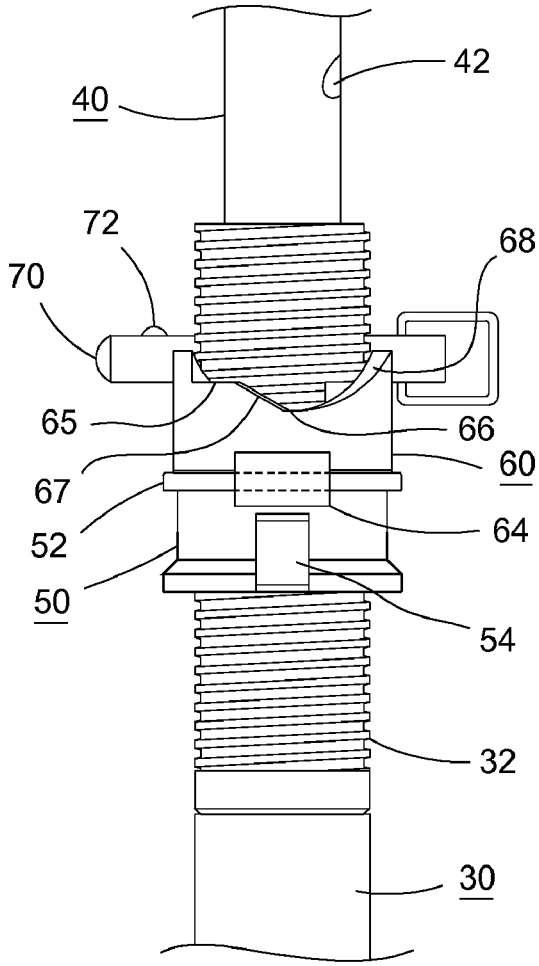
FIG. 5 is a side view according to FIG. 3.

Please refer to FIGS. 3 and 4. According to a first embodiment, the prop 20 of the present invention includes an outer tube 30, an inner tube 40, a locating nut 50, an insertion pin 70 and a controlling member 60.

A top end of the outer tube 30 is a threaded section 32 with a thread formed on outer circumference of the threaded section. The threaded section and the outer tube 30 can be a one-piece member or two pieces fixedly connected with each other. A pair of slots 34 is axially formed on the threaded section 32 of the outer tube 30.

The inner tube 40 is telescopically fitted in the outer tube 30. The inner tube 40 is formed with several pairs of pinholes 42 axially arranged at equal intervals.

The locating nut 50 is screwed on the threaded section 32 of the outer tube 30. By means of turning the nut 50, the height of the nut 50 on the threaded section 32 can be adjusted. An annular rib 52 is formed on outer circumference of the nut 50. Preferably, the annular rib 52 is positioned on top edge of the nut 50. Two lugs 54 are disposed on two sides of the nut 50.

The controlling member 60 is a collar member. A pair of through holes 62 is radially formed on the circumference of the controlling member 60. An insertion section 64 is formed on bottom face of the controlling member 60. In this embodiment, the insertion section 64 is composed of two hook edges (a) formed on two sides of the controlling member. Two recessed/projecting structures are formed on top face of the controlling member 60 at equal intervals. Preferably, each of the recessed/projecting structures is a 180-degree arc. Each of the recessed/projecting structures has a standard position 65, a releasing position 66 formed on one side of the standard position 65 and an adjoining face 67 located between the standard position 65 and the releasing position 66. The adjoining face is a slope, two ends of which respectively adjoin with the standard position and the releasing position. An inclined guide face 68 is formed on the other side of the standard position 65. The guide face 68 has a higher end 681 and a lower end 682. The higher end 681 adjoins with the standard position 65. In this embodiment, the higher end 681 of the guide face 68 is higher than the standard position 65. However, this is not limited. The higher end can be alternatively at the same height as the standard position. The other side of the releasing position 66 adjoins with the lower end 682 of the guide face 68 of the other recessed/projecting structure.

Figure 6:
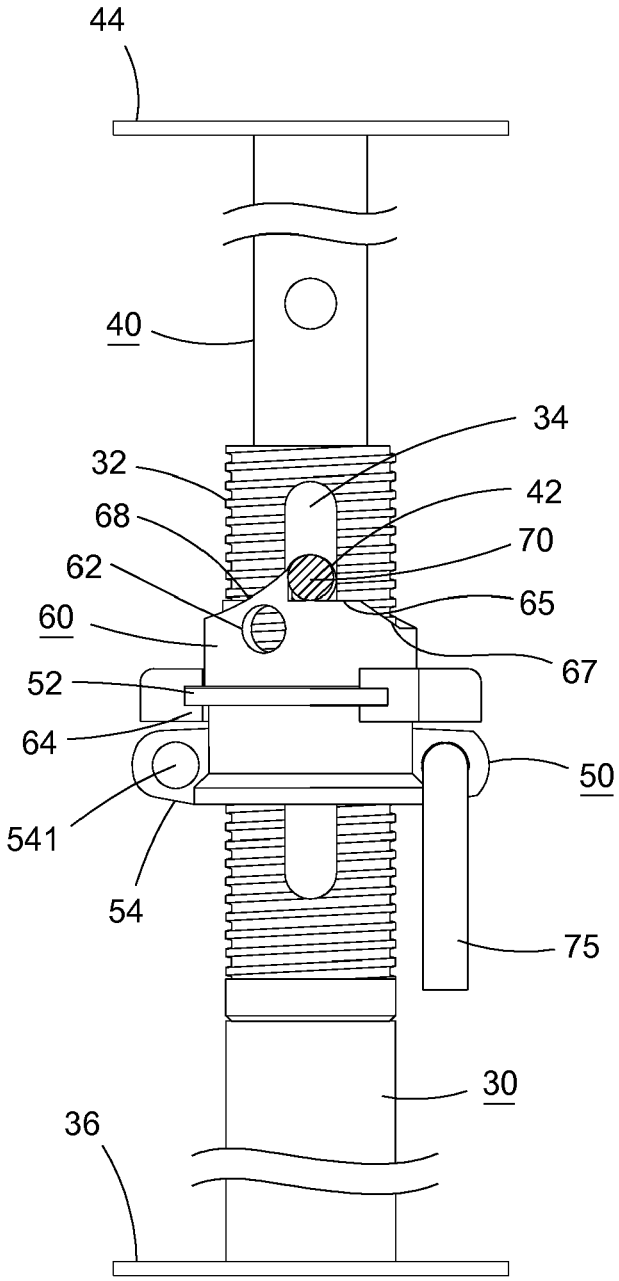
FIG. 6 shows that the prop of the present invention is used to support a moldboard.

When assembled, the insertion section 64, that is, the hook edges (a) of the controlling member 60 are hooked with the annular rib 52 of the locating nut 50, whereby the controlling member 60 is connected with the locating nut 50 as shown in FIGS. 3 and 6. The controlling member 60 is directly overlaid on the nut 50. Then the locating nut 50 is screwed on the threaded section 32 of the outer tube 30. With the nut 50, the controlling member 60 is fitted on the threaded section 32 of the outer tube. Then the inner tube 40 is telescoped into the outer tube 30 as shown in FIG. 3. Finally, the insertion pin 70 is inserted through the prop 20. A resiliently retractable steel ball 72 is embedded in front end of the insertion pin 70.

The connection between the controlling member 60 and the nut 50 is characterized in that when the nut 50 is adjusted to another height, the controlling member 60 changes its height along with the nut. Furthermore, the controlling member is movably/rotatably connected with the nut. Therefore, the controlling member and the nut are rotatable relative to each other. That is, when turning the nut 50, the controlling member 60 is not rotated along with the nut 50, and vice versa.

The prop of the present invention can be used in two manners. The first manner is to bear the axial pressure. Referring to FIG. 6, with the prop 20 positioned upright, the support board 36 of the bottom end of the outer tube 30 contacts the ground. The top end of the inner tube 40 is moved to a position near the moldboard (not shown). Then the insertion pin 70 is fitted through the slots 34 of the outer tube 30 and inserted into one pair of the pinholes 42 of the inner tube 40. And make the insertion pin rest on the standard position 65 of the controlling member 60. Then the locating nut 50 is turned to rise. At this time, the controlling member 60, the insertion pin 70 and the inner tube 40 are moved upward along with the nut. An L-shaped rod 75 as shown in FIG. 3 or other suitable rod can be inserted into the hole 541 of the lug 54 of the nut to turn the nut. During the turning operation, the controlling member 60, the insertion pin 70 and the inner tube 40 are simply moved without rotating. After the support board 44 of the top end of the inner tube 40 abuts against the moldboard, the prop 20 serves to support the moldboard to bear the pressure in grouting.

After the concrete is hardened, the prop can be quickly separated from the moldboard. The controlling member 60 is turned leftward from the position of FIG. 6 to the position of FIG. 7. At this time, the insertion pin 70 leaves the standard position 65 to drop onto the releasing position 66 which is lower. Simultaneously, the inner tube 40 quickly drops to a certain height along with the insertion pin 70. At this time, the top end of the inner tube quickly separates from the moldboard. Accordingly, it is unnecessary for a user to turn the nut 50 for lowering the inner tube. Instead, by means of turning the controlling member, the prop can be quickly separated from the moldboard to save time for lowering the inner tube. When the insertion pin 70 leaves the standard position 65 to drop onto the releasing position 66, the insertion pin will first contact the adjoining face 67 and then reach the releasing position 66. The adjoining face 67 provides a buffering effect so as to prevent the insertion pin from directly gravitationally dropping from the standard position onto the releasing position.

Figure 8:
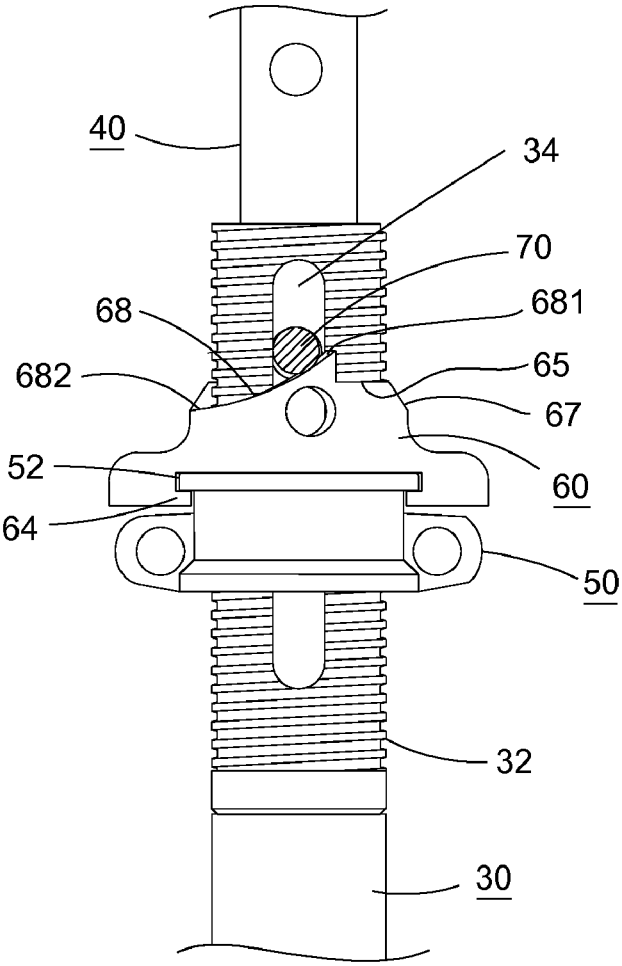
FIG. 8 shows that the prop of the present invention is restored to the state of FIG. 6.
Figure 7:
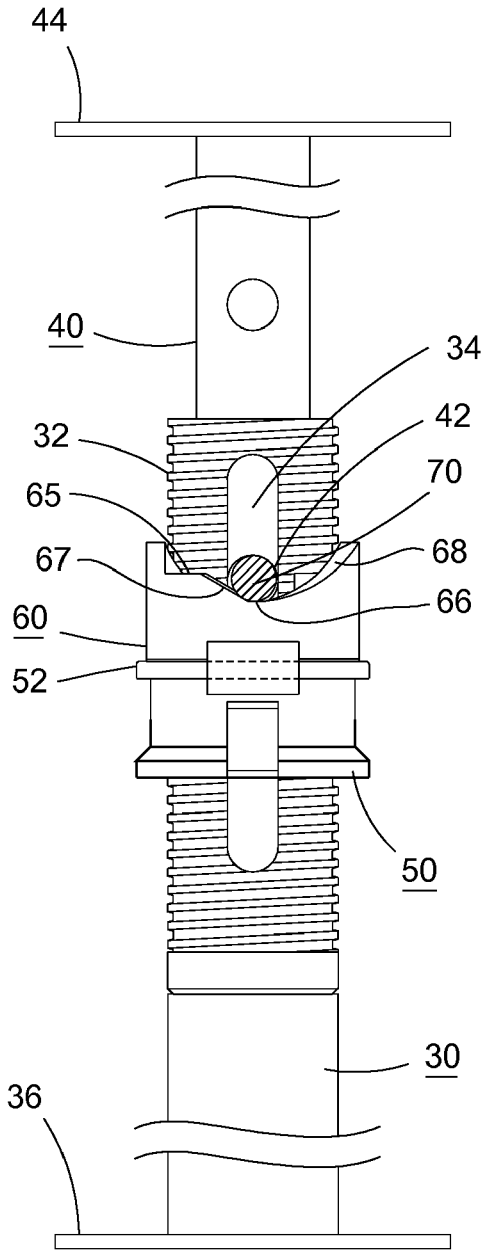
FIG. 7 is a view according to FIG. 6, showing that the inner tube of the prop is lowered.

When the controlling member 60 is turned leftward from the state of FIG. 7, the insertion pin 70 goes from the releasing position 66 to the guide face 68 and moves along the guide face from the lower end 682 of the guide face to the higher end 681 thereof as shown in FIG. 8. At this time, the insertion pin 70 is restored to the state of FIG. 6 and the insertion pin 70 and the inner tube 40 are relocated on the standard position 65 for next use.

Figure 9:
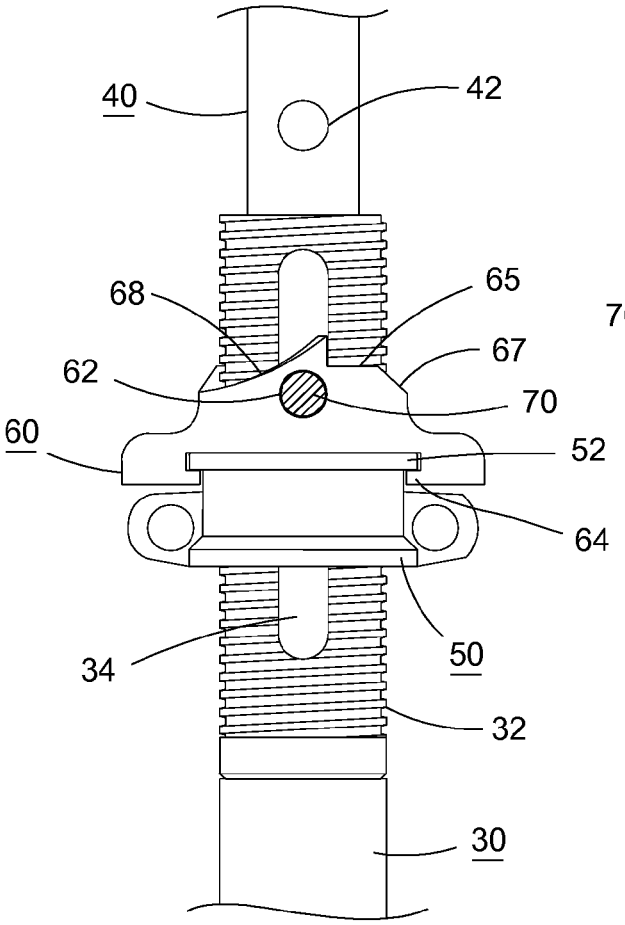
FIG. 9 is a front view of the first embodiment of the prop of the present invention, which is used in another mode.
Figure 10:
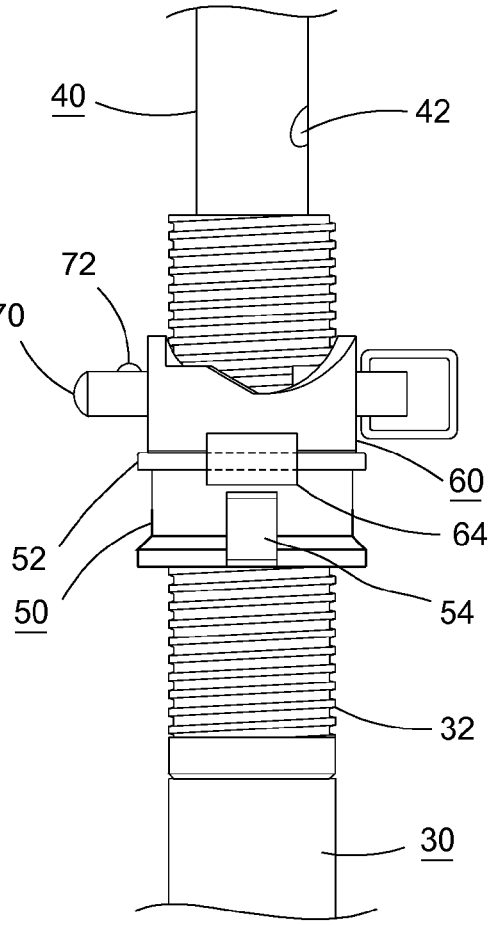
FIG. 10 is a side view according to FIG. 9.

In the second manner, the prop 20 is able to bear bidirectional action force. Referring to FIGS. 9 and 10, the insertion pin 70 is fitted through the through holes 62 of the controlling member 60, the slots 34 of the outer tube 30 and one pair of pinholes 42 of the inner tube 40. According to this arrangement, due to the nut 50, the controlling member 60 is located on the outer tube 30 and cannot displace along the axis of the prop. Relatively, the insertion pin 70 and the inner tube 40 are restricted by the controlling member 60 from displacing. Under such circumstance, no matter whether the inner tube is stressed or tensioned, the inner tube will not slide. Similarly, by means of turning the nut 50, the length of the prop can be adjusted.

Accordingly, the prop can bear axial pressure and tension and thus is applicable to those fields other than supporting a horizontal moldboard. For example, the prop is usable for building a scaffold, a stage, etc. In addition, the prop serves as a link or an oblique lever for construction site. Therefore, the prop of the present invention is versatile and multifunctional.

Figure 11:
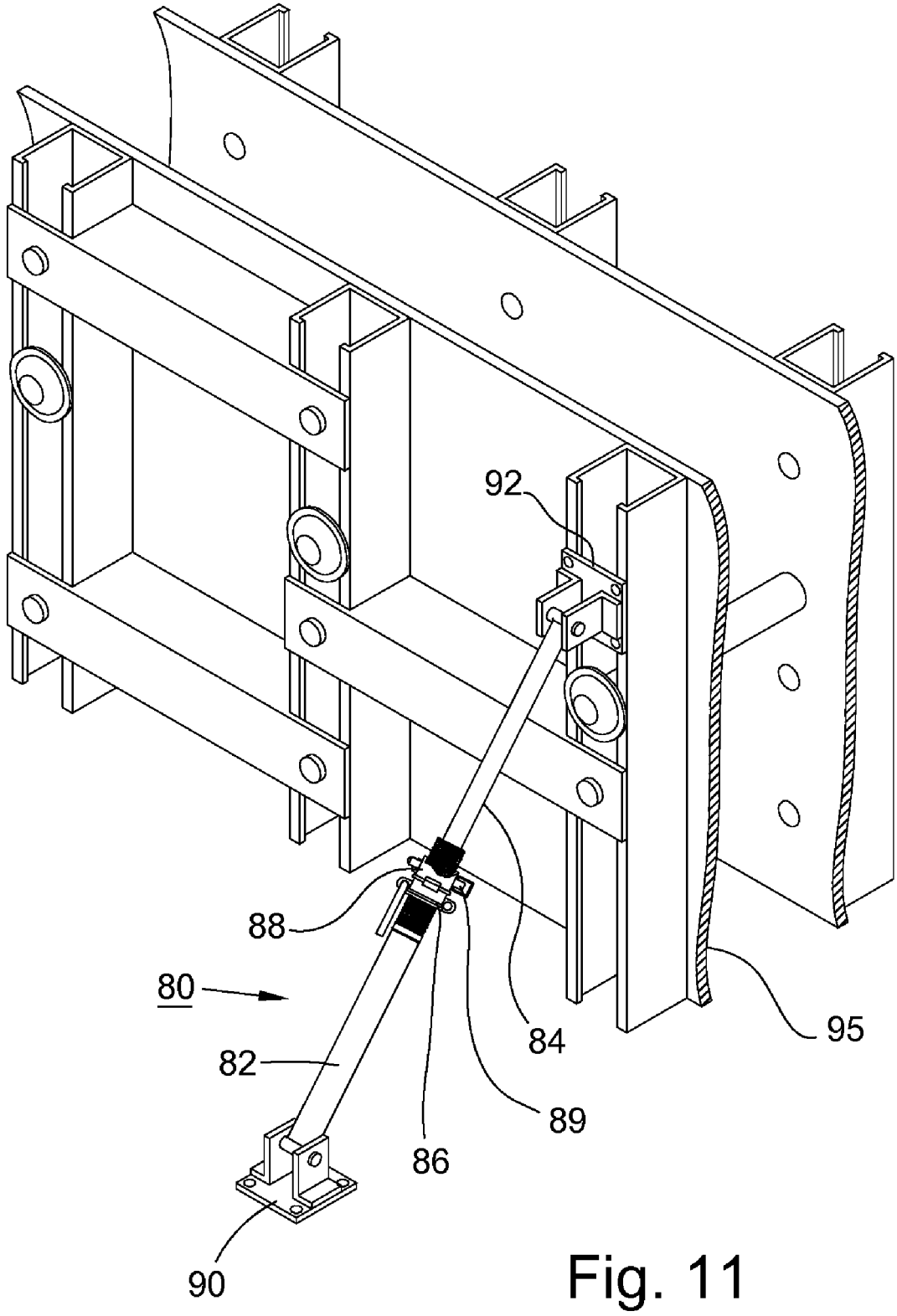
FIG. 11 is a perspective view of a second embodiment of the prop of the present invention, showing the use thereof.

FIG. 11 shows a second embodiment of the prop 80 of the present invention. The inner and outer tubes 84, 82, the locating nut 86, the controlling member 88 and the insertion pin 89 of this embodiment are identical to those of the first embodiment and thus will not be repeatedly described hereinafter.

Two support boards 90, 92 are respectively pivotally connected with free ends of the inner and outer tubes 82, 84. Therefore, the support boards 90, 92 can freely swing. The prop 80 is arranged in the state of FIG. 9. Accordingly, the prop can be inclined as an oblique support rod for fixing an upright moldboard 95.

The prop of the present invention can be quickly lowered, whereby the prop can be quickly separated from the moldboard to save operation time and speed detachment of the moldboard. Moreover, the prop of the present invention is able to bear bidirectional action force so that the usage of the prop is widened.

The above embodiments are only used to illustrate the present invention, not intended to limit the scope thereof. Many modifications of the above embodiments can be made without departing from the spirit of the present invention.

What is claimed is:

1. A prop comprising:

an outer tube, a top end of the outer tube having a threaded section; a pair of slots being axially formed on the threaded section of the outer tube;

an inner tube telescopically fitted in the outer tube, the inner tube being formed with several pairs of pinholes axially arranged at intervals;

a locating nut screwed on the threaded section of the outer tube;

a controlling member which is a collar member; a pair of through holes being radially formed on the controlling member, two recessed/projecting structures being formed on a top face of the controlling member at equal intervals, each of the recessed/projecting structures having a standard position, a releasing position lower than the standard position and formed on one side of the standard position, and an adjoining face connected between the standard position and the releasing position; the controlling member being fitted around the outer tube, a bottom end of the controlling member being undetachably and relatively rotatably connected with a top end of the locating nut; and an insertion pin which being able to be fitted through the slots of the outer tube and inserted in one pair of pinholes of the inner tube, and the insertion pin being rested on the top face of the controlling member; alternatively, the insertion pin being able to be fitted through the slots of the outer tube and inserted in one pair of pinholes of the inner tube and the through holes of the controlling member;

each of the recessed/projecting structures of the controlling member further has an inclined guide face, the guide face having a higher end and a lower end, the higher end of the guide face adjoining with another side of the standard position, the lower end of the guide face adjoining with the releasing position of the other recessed/projecting structure; and the higher end of the guide face is higher than the standard position.

2. The prop as claimed in claim 1, wherein the adjoining face is a slope.

3. The prop as claimed in claim 2, wherein the higher end of the guide face is higher than the standard position.

4. The prop as claimed in claim 1, wherein an insertion section is formed on the bottom end of the controlling member, the insertion section being connected with the locating nut by means of insertion.

5. The prop as claimed in claim 4, wherein an annular rib is formed on outer circumference of the top end of the locating nut; the insertion section of the controlling member being inserted with the annular rib.

6. The prop as claimed in claim 5, wherein the insertion section has at least two hook edges hooked with the annular rib of the locating nut.

7. The prop as claimed in claim 1, wherein two support boards are respectively disposed at free ends of the inner tube and the outer tube.

8. The prop as claimed in claim 1, wherein two support boards are respectively pivotally disposed at free ends of the inner tube and the outer tube, whereby the support boards are able to be freely rotated.

9. A prop comprising:

an outer tube, a top end of the outer tube having a threaded section; a pair of slots being axially formed on the threaded section of the outer tube;

an inner tube telescopically fitted in the outer tube, the inner tube being formed with several pairs of pinholes axially arranged at intervals;

a locating nut screwed on the threaded section of the outer tube;

a controlling member which is a collar member; a pair of through holes being radially formed on the controlling member; a bottom end of the controlling member being undetachably and relatively rotatably connected with an end of the locating nut; and an insertion pin fitted through the through holes of the controlling member and the slots of the outer tube and inserted in one pair of pinholes of the inner tube;

two recessed/projecting structures being formed on a top face of the controlling member at equal intervals;

each of the recessed/projecting structures of the controlling member further has an inclined guide face, the guide face having a higher end and a lower end, the higher end of the guide face adjoining with one side of a standard position, the lower end of the guide face adjoining with a releasing position of the other recessed/projecting structure; and the higher end of the guide face is higher than the standard position.

10. The prop as claimed in claim 9, wherein an insertion section is formed on the bottom end of the controlling member, the insertion section being connected with the locating nut by means of insertion.

11. The prop as claimed in claim 10, wherein an annular rib is formed on outer circumference of the top end of the locating nut; the insertion section of the controlling member being inserted with the annular rib.

12. The prop as claimed in claim 11, wherein the insertion section has at least two hook edges hooked with the annular rib of the locating nut.

13. The prop as claimed in claim 9, wherein two support boards are respectively disposed at free ends of the inner tube and the outer tube.

14. The prop as claimed in claim 9, wherein two support boards are respectively pivotally disposed at free ends of the inner tube and the outer tube, whereby the support boards are able to be freely rotated.

* * * * *